United States Patent [19]

Robertson

[11] Patent Number: 4,807,655

[45] Date of Patent: Feb. 28, 1989

[54] GARDEN OR SUN UMBRELLAS

[76] Inventor: Malcolm S. Robertson, "Taigh-Beag", Dunally Park, Shepperton, Middlesex, United Kingdom

[21] Appl. No.: 116,028

[22] Filed: Nov. 3, 1987

[51] Int. Cl.[4] ..... A45B 25/14

[52] U.S. Cl. ..... 135/22; 135/20 M

[58] Field of Search ..... 135/22, 24, 20 M

[56] References Cited

U.S. PATENT DOCUMENTS

| | | | |
|---|---|---|---|
| 1,070,894 | 8/1913 | Hopkins | 135/22 |
| 2,721,569 | 10/1955 | Militano | 135/20 M |
| 3,150,671 | 9/1964 | Frey | 135/20 M |
| 3,732,881 | 5/1973 | Hirai . | |
| 4,011,881 | 3/1977 | Becher | 135/98 |
| 4,192,543 | 3/1980 | Crawford | 135/88 |
| 4,252,137 | 2/1981 | Cohen | 135/69 |
| 4,319,600 | 3/1982 | Roche | 135/20 M |
| 4,424,824 | 1/1984 | Becher | 135/20 M |
| 4,543,971 | 10/1985 | Sirota | 135/20 M |
| 4,747,422 | 5/1988 | Chung | 135/20 M |

FOREIGN PATENT DOCUMENTS

| | | | |
|---|---|---|---|
| 25625 | 9/1906 | Austria . | |
| 123489 | 9/1900 | Fed. Rep. of Germany . | |
| 2236149 | 2/1974 | Fed. Rep. of Germany . | |
| 339726 | 6/1904 | France | 135/23 |
| 1357870 | 6/1974 | United Kingdom . | |

*Primary Examiner*—David A. Scherbel
*Assistant Examiner*—Caroline D. Dennison
*Attorney, Agent, or Firm*—Sheridan, Ross & McIntosh

[57] ABSTRACT

According to the invention a garden or sun umbrella is provided with spring means for automatically opening the umbrella. In a preferred embodiment the spring is a gas spring mounted inside the central post of the umbrella and is operatively connected to a collar slidably mounted on the post and which in turn is connected via struts to the arm of the umbrella, by means of a flexible cord connected at its opposite ends to the collar and reeved around pulley blocks at opposite ends of the gas spring. After manually initiating the opening of the umbrella by pivoting the arms, in the collapsed position, away from the post, the opening action is completed automatically by the action of the spring. Closing of the umbrella is effected by downward pressure on the arms of the umbrella against the action of the spring.

5 Claims, 1 Drawing Sheet

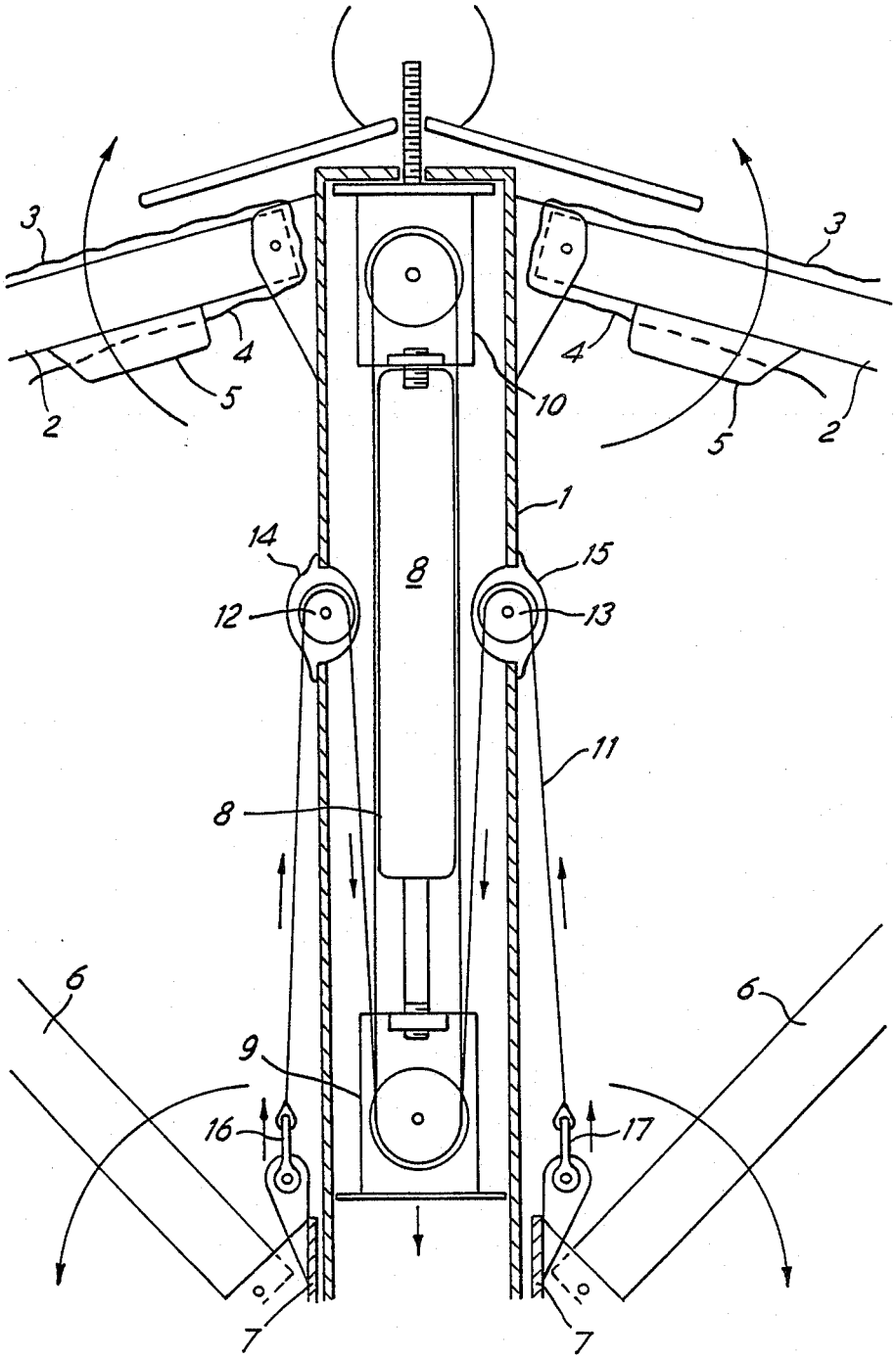
3
3
4
4
5
5
2
2
10
1
14
15
8
12
13
11
8
6
6
9
16
17
7
7

GARDEN OR SUN UMBRELLAS

FIELD OF THE INVENTION

This invention relates to large umbrellas of the kind which stand on the ground and are used as sunshades and which are variously referred to as garden umbrellas or sun umbrellas. For convenience they will be referred to hereinafter simply as garden umbrellas.

BACKGROUND

Umbrellas of the kind described above comprise a central post or support, a plurality of arms or ribs hinged to the upper end of the central post and spaced therearound, means for raising those arms or ribs from a collapsed position alongside the central post to an erected or open position in which those arms extend in radial array around the post to form the frame of the umbrella, a fabric canopy attached, usually removably so, to those arms or ribs, and means for locking or holding those arms in the extended or open position of the umbrella.

In one arrangement the means for erecting or opening the umbrella comprises a strut hingedly connected at one end to each rib at an intermediate point thereon and at the other end to a collar or ring positioned about and axially slidable along the central post or support. To open the umbrella the collar or ring is pushed upwardly to a position in which the struts support the ribs in open array. Releasable means are provided to lock the collar or ring in its upper position thereby to hold the umbrella in its open position.

PRIOR ART

In UK-A-1,357,870 a sun umbrella is disclosed in which the umbrella is opened by a handle pivotally connected to the crown member of the umbrella by a flexible cable, and in German Petty Patent No. GM 8230261 a sun or garden umbrella is disclosed in which a gas spring is used to adjust the vertical height of the umbrella, but not the opening action.

Other prior art relating to umbrellas of the kind described and which has been taken into account in preparing this application is German published patent application No. 2236149, German Pat. No. 123489, Austrian Pat. No. 25625 and U.S. Pat. No. 3,732,881, all of which disclose umbrellas with various kinds of automatic opening mechanisms.

OBJECT OF THE INVENTION

The object of the present invention is to provide a sun umbrella with improved automatic opening means.

SUMMARY OF THE INVENTION

According to the invention a spring is located inside the central support or post of an umbrella or sunshade of the kind described. Means are provided operatively connecting the spring to the collar to bias the collar permanently towards the upper position, i.e. the open position of the umbrella. Preferably the spring is a gas spring, whose operating characteristics are designed to power a slow opening of the umbrella but a rapid collapse, once the collapse has been initiated by downward pressure on the arms of the open umbrella.

BRIEF DESCRIPTION OF THE DRAWING

The single figure drawing accompanying this application illustrates a vertical section through the automatic opening means for a sun umbrella according to this invention.

DETAILED DESCRIPTION

According to this invention there is provided a garden or sun umbrella comprising a central post for supporting the umbrella, a plurality of arms hinged to the upper end of the post and spaced therearound, said arms being pivotable from a first, collapsed position in which they hang down alongside the central post to a second, open position in which they extend in radial array around the post to support the fabric canopy of the umbrella, and means for erecting the umbrella, said erecting means comprising a plurality of struts hingedly connected at one end to the arms of the umbrella and at the other to a collar slidable axially on the central post to open and close the umbrella, wherein automatic opening means are provided for the automatic opening of the umbrella, said automatic opening means comprising a spring member mounted inside the post and means connecting the spring to the collar and operable to bias the collar in a direction to effect the opening of the umbrella.

If desired locking means can be provided to lock the umbrella in its open condition, but preferably the umbrella is so designed that it is held in the open position solely by the action of the spring. A stop can be provided, if necessary, on the upper part of the post to limit the upward travel of the collar, and thereby provide means for positively locating the collar on the post when the umbrella is in its open condition.

Means can likewise be provided to hold the arms or ribs in the collapsed condition against the bias of said spring, but in the preferred arrangement, the design is such that the arms or ribs will remain in the collapsed condition under their own weight until such time as the upward or opening action is initiated by an initial manual movement of the free ends of the arms outwardly and upwardly away from the post.

In the preferred embodiment, the means operatively connecting the spring to the collar comprise a flexible cord fastened at both ends to the collar and passing internally of the hollow post over pulleys mounted in sheave blocks located in apertures on opposite sides of the post, and passing over at least one pulley rotatably mounted on the spring. Preferably, in order to provide a long lifting action and mechanical advantage the cord is reeved around pulleys mounted at each end of the spring.

A preferred embodiment of the hoisting mechanism of this invention is illustrated in the accompanying drawing to which reference will now be made.

Referring to the drawing, numeral 1 indicates the hollow central post of the umbrella. Hinged to the upper end of the post are the arms or ribs 2 of the umbrella which support the fabric canopy 3. This is detachably fastened by ropes or cords 4 stitched or otherwise attached to the canopy and secured in jamming cleats 5 on the underside of each end of each arm.

Struts 6 are hingedly connected (not shown) intermediate the ends of each arm 2 and to a collar 7 freely movable on the post 1.

Located in the upper end of the post 1 is a gas spring 8 carrying at its opposite ends pulley blocks 9 and 10.

Operatively connecting the gas spring 8 to the collar 7 is a flexible cord 11 reeved around the pulley blocks 9 and 10 and passing over two further pulleys 12 and 13 mounted in sheave blocks 14, 15 in apertures on opposite sides of the post 1. At its opposite ends the cord 11 is connected to the collar by shackles 16, 17.

As will be apparent, the gas spring 8 is mounted in compression in the loop formed internally of the post 1 by the cord 11 reeved around the pulleys 9, 10 and exerts a lifting action on the collar 7.

In the collapsed condition of the umbrella, the collar 7 will be in its lowermost position on the post, and the gas spring will be in its maximum state of compression. In this position, the arms 2 will hang down alongside the post 1, and the design parameters are such that in this position the arms will remain there under their own weight. Less preferably, means can be provided to fasten or hold the arms in the collapsed position. Upon release of the fastening, or in the preferred arrangement, an initial manual movement of the free ends of the arms 2 away from the post initiates the automatic opening of the umbrella, under the action of the gas spring 8 as indicated by the direction of the heavy arrows. Preferably the operating characteristics of the gas spring are such that this opening action takes place relatively slowly.

In the open position, the canopy is supported solely by the action of the spring 8, and if desired a stop (not shown) can be provided on the post 1 to locate the collar 7 at the upper limit of its travel. Similarly, although unnecessarily, a latch can be provided to lock the umbrella in its open position.

In order to close the umbrella, downward pressure is simply applied to the outer ends of the arms 2. This initiates the collapse of the arms, and recompression of the gas spring in readiness for the next opening action. Preferably the operating characteristics of the spring are such that the collapse takes place more rapidly than the opening.

As will be apparent, the present invention at least in its preferred embodiment provides a simple but effective mechanism for the automatic opening of large umbrellas, and one which is easily maintained. In particular, in the preferred arrangement, the gas spring 8 and its associated pulley blocks 9 and 10 are a unitary assembly which is a loose sliding fit in the post 1, being held in position simply by the cord 11. Cutting or unfastening the cord simply allows the gas spring assembly to drop out the bottom of the post, and from which it can be recovered for repair or maintenance. Following that, the assembly is reinserted into the post and the cord rethreaded.

Besides providing an automatic opening mechanism, the invention has further advantages in that, in its open position the arms 2 are not rigidly locked in position, at least in the preferred embodiments, but are resiliently supported by the spring. This gives the umbrella a degree of resilient flexibility which is of value if the umbrella is left open in windy or strong conditions. The resiliency will also help to accommodate differential tensions in the canopy, caused for example during initial tensioning and stretching of the canopy onto the frame, but also any permanent or temporary shrinkage of the canopy such as might occur, for example, if the canopy gets wet. The canopy is therefore less subject to damage, for example, tearing.

Various modifications can be practiced in the above described design without departing from the concept of this invention or the spirit and scope of the invention as hereinafter defined in the appended claims.

I claim:

1. In a garden or sun umbrella comprising a central post for supporting the umbrella, a plurality of arms hinged to the upper end of the post and spaced therearound, said arms being pivotable from a first, collapsed position in which they hang down alongside the central post to a second open position in which they extend in radial array around the post to support the fabric canopy of the umbrella, and means for erecting the umbrella, said erecting means comprising a plurality of struts hingedly connected at one end to the arms of the umbrella and at the other to a collar slidable axially on the central post to open and close the umbrella, an automatic opening means for opening the umbrella, said automatic opening means comprising a gas spring mounted inside the central post at its upper end, and means connecting the gas spring to the slidable collar externally mounted on said post to bias the collar upwardly thereon so as to effect the automatic opening of the umbrella by said spring, which spring also serves to hold the canopy in the open position against the weight of said canopy and said arms, and wherein the closing of the umbrella is effected by downward manual pressure on the distal ends of said arms to pivot said arms from the open to the collapsed position with consequent compression of the gas spring in preparation for a subsequent opening of the umbrella, and wherein the pivotal connections of struts to said collar and said arms provide a mechanical disadvantage such that, in the collapsed condition of the umbrella, the gas spring is held in compression solely by the combined weight of the canopy and the arms, until the opening of the umbrella is initiated by an initial outward pivoting of the distal ends of the arms away from the central post thereby to overcome said mechanical disadvantage.

2. An umbrella according to claim 1, wherein said connecting means comprise a flexible cord connected at its opposite ends to said collar and passing upwardly therefrom two pulleys mounted in slots on opposite sides of the post intermediate the ends of the gas spring, and extending downwardly therefrom inside the central post and connected internally of the post to the lower end of the gas spring, whereby extension of the gas spring under its internal gas pressure draws said flexible cord into the post, thereby to pull the collar upwardly on the post and automatically effect opening of the umbrella.

3. An umbrella according to claim 2, wherein the flexible cord member is reeved around pulleys at both ends of the gas spring.

4. In a garden or sun umbrella comprising a central post for supporting the umbrella, a plurality of arms hinged to the upper end of the post and spaced therearound, said arms being pivotable from a first, collapsed position in which they hang down alongside the central post to a second open position in which they extend in radial array around the post to support the fabric canopy of the umbrella, and means for erecting the umbrella, said erecting means comprising a plurality of struts hingedly connected at one end to the arms of the umbrella and at the other to a collar slidable axially on the central post to open and close the umbrella, an automatic opening means for opening the umbrella, said automatic opening means comprising a gas spring mounted inside the central post at its upper end, and a flexible cord connected at its opposite ends to the slidable collar and passing upwardly therefrom over two pulleys mounted in slots on opposite sides of the central post adjacent a point intermediate the ends of the gas spring and downwardly therefrom inside the post around a third pulley mounted on the lower end of the gas spring, whereby extension of the gas spring under its internal gas pressure draws its flexible cord into the post, thereby to pull the collar upwardly on the post and automatically effect the opening of the umbrella by said spring, which spring also serves to hold the canopy in the open position against the weight of said canopy and said arm, and wherein the closing of the umbrella is effected by downward manual pressure on the distal ends of said arms to pivot said arms from the open to the collapsed position with consequent compression of the gas spring in preparation for a subsequent opening of the umbrella, and wherein the pivotal connections of struts to said collar and said arms provide a mechanical disadvantage such that, in the collapsed condition of the umbrella, the gas spring is held in compression solely by the combined weight of the canopy and the arms, until the opening of the umbrella is initiated by an initial outward pivoting of the distal ends of the arms away from the central post thereby to overcome said mechanical disadvantage.

5. An umbrella according to claim 4, wherein the flexible cord is reeved around pulleys at both ends of the gas spring.

* * * * *